US009908599B2

(12) United States Patent
Zulonas et al.

(10) Patent No.: US 9,908,599 B2
(45) Date of Patent: Mar. 6, 2018

(54) HEADS-UP DISPLAY FOR DISPLAYING A PARTIAL PRESSURE OF OXYGEN TO A DIVER

(71) Applicant: Shearwater Research Inc., Vancouver (CA)

(72) Inventors: Kevin Zulonas, Vancouver (CA); Tyler Coen, Burnaby (CA); Mitchell Gordon Burton, Coquitlam (CA)

(73) Assignee: Shearwater Research Inc., Richmond (CA)

( * ) Notice: Subject to any disclaimer, the term of this patent is extended or adjusted under 35 U.S.C. 154(b) by 492 days.

(21) Appl. No.: 14/287,162

(22) Filed: May 26, 2014

(65) Prior Publication Data

US 2014/0345608 A1 Nov. 27, 2014

Related U.S. Application Data

(60) Provisional application No. 61/827,528, filed on May 24, 2013.

(51) Int. Cl.
*B63C 11/22* (2006.01)
*B63C 11/18* (2006.01)

(52) U.S. Cl.
CPC ..... *B63C 11/22* (2013.01); *B63C 2011/188* (2013.01)

(58) Field of Classification Search
CPC ..... B63C 11/22; A61M 2016/0027; A61M 2230/435; A62B 9/00; A62B 9/006; A62B 18/00; A62B 18/08; G01F 23/00; G01F 23/14; G01F 23/18; G01F 23/185; G01L 7/00; G01L 7/026; G01L 7/045; G01L 7/065; G01L 7/086; G01L 7/106; G01L 7/187; G08B 21/00; G08B 21/18; G08B 21/182
See application file for complete search history.

(56) References Cited

U.S. PATENT DOCUMENTS 3,735,382 A * 5/1973 Soult ..... A61B 5/0833 340/321
4,236,546 A * 12/1980 Manley ..... B63C 11/24 128/204.22
5,526,280 A * 6/1996 Consadori ..... G01N 33/0063 340/632
6,032,664 A * 3/2000 Gray ..... A62B 9/00 128/201.27
6,401,714 B1 6/2002 Giorgini
6,519,548 B1 2/2003 Kuroda et al.
6,856,578 B2 2/2005 Magine et al.
7,628,153 B2 12/2009 Juergensen
(Continued)

OTHER PUBLICATIONS

Open Safety. Apocalypse Type IV Rebreather User Manual. copyright 2009.*

*Primary Examiner* — Kathryn E Ditmer
(74) *Attorney, Agent, or Firm* — Cameron IP

(57) ABSTRACT

A heads-up display has a display panel which displays information related to a partial pressure of oxygen in a breathing gas. The display panel comprises a first indicia, a second indicia, a third indicia, and a fourth indicia. The first indicia and the fourth indicia respectively indicate a near hyperoxic condition and a near hypoxic condition. The second indicia and the third indicia together indicate the partial pressure of oxygen in the breathing gas.

12 Claims, 13 Drawing Sheets

(56) References Cited

U.S. PATENT DOCUMENTS

| | | | | |
|---|---|---|---|---|
| 7,927,558 | B2 | 4/2011 | Kirollos et al. | |
| 8,028,696 | B2 | 10/2011 | Juergensen | |
| 2004/0046710 | A1* | 3/2004 | Adams | A62B 9/006 345/8 |
| 2005/0183721 | A1* | 8/2005 | Juergensen | G08B 6/00 128/202.22 |
| 2005/0217676 | A1* | 10/2005 | Parker | B63C 11/186 128/205.23 |
| 2007/0215157 | A1 | 9/2007 | Straw | |
| 2009/0126482 | A1* | 5/2009 | Fundak | A62B 9/006 73/293 |
| 2012/0132207 | A1 | 5/2012 | Straw | |
| 2013/0257621 | A1* | 10/2013 | Juergensen | B63C 11/02 340/626 |

* cited by examiner

Display mode 1

| $ppO_2$ level | Top red row | Middle top row | Middle bottom row | Bottom red row |
|---|---|---|---|---|
| ≤ 0.4 bar | —— | —— | —— | Flashes red X times |
| 0.5 to 0.9 bar | —— | Solid on | Flashes X times | —— |
| 1.0 bar | —— | Solid on | Solid on | —— |
| 1.1 to 1.5 bar | —— | Flashes X times | Solid on | —— |
| ≥ 1.6 bar | Flashes red X times | —— | —— | —— |

*Where X = | 10*([Current $ppO_2$] - 1.0) | , i.e. 1.4 - 1.0 = 4 flashes
**Each column responds to $ppO_2$ independently
***Display pattern repeats with a period of 5 seconds
****Note: colours of Middle Top Row and Middle Bottom Row are distinct, but may be reversed based on user`s configuration (left hand side mode vs right hand side mode, user configurable)

FIG. 12A

Display mode 2

| $ppO_2$ level | Top red row | Green row | Amber row | Bottom red row |
|---|---|---|---|---|
| ≤ 0.4 bar | —— | —— | —— | Flashes red X times |
| 0.5 to 0.9 bar | —— | —— | Flashes X times | —— |
| 1.0 bar | —— | Flashes once | Flashes once | —— |
| 1.1 to 1.5 bar | —— | Flashes X times | —— | —— |
| ≥ 1.6 bar | Flashes red X times | —— | —— | —— |

*Where X = | 10*([Current $ppO_2$] - 1.0) | , i.e. 1.4 - 1.0 = 4 flashes
**Each column responds to $ppO_2$ independently
***Display pattern repeats with a period of 5 seconds

FIG. 12B

HEADS-UP DISPLAY FOR DISPLAYING A PARTIAL PRESSURE OF OXYGEN TO A DIVER

BACKGROUND OF THE INVENTION

Field of the Invention

The present invention relates to a heads-up display and, in particular, to a heads-up display for displaying the partial pressure of oxygen in a breathing gas.

Description of the Related Art

It is known to provide rebreathers with a heads-up display to display information related to the partial pressure of oxygen in a breathing gas. For example, U.S. Patent Application Publication Number 2007/0215157, which was published on Sep. 20, 2007 in the name of Straw, discloses a rebreather heads-up display which displays information related to the partial pressure of oxygen in the breathing gas along a color continuum using a RGB light-emitting diode. Specific colors indicate specific conditions. For example, blue may indicate a near hypoxic mix of breathing gas, green may indicate a near user set point mix of breathing gas, and red may indicate a near hyperoxic mix of breathing gas. Color changes may be discrete or continuous to indicate condition changes. Alarm conditions may be shown by flashing colors or a white light.

Other conventional rebreather heads-up displays may use other color schemes to display information related to the partial pressure of oxygen in the breathing gas. For example, a heads-up display with a tri-color light-emitting diode may be used to display the actual partial pressure of oxygen in the breathing gas using the Smithers code in which a yellow flash indicates a partial pressure of oxygen of 1.0 bar and each subsequent green flash indicates 0.1 bar above 1.0 bar while each subsequent red flash indicates 0.1 bar below 1.0 bar. A partial pressure of oxygen of 1.2 bar is accordingly displayed by a yellow flash followed by two green flashes while a partial pressure of oxygen of 0.8 bar is displayed by a yellow flash followed by two red flashes.

However, while color schemes may be used to effectively display information related to the partial pressure of oxygen in the breathing gas to color sighted users, there is a need for a rebreather heads-up display that effectively displays information related to the partial pressure of oxygen in the breathing gas to both color sighted users and color blind users.

SUMMARY OF THE INVENTION

There is provided a heads-up display having a display panel which displays information related to a partial pressure of oxygen in a breathing gas. The display panel comprises a first indicia, a second indicia, a third indicia, and a fourth indicia. The first indicia and the fourth indicia respectively indicate a near hyperoxic condition and a near hypoxic condition. The second indicia and the third indicia together indicate the partial pressure of oxygen in the breathing gas.

The first indicia may flash to indicate the near hyperoxic condition. The fourth indicia may flash to indicate the near hypoxic condition. When the partial pressure of oxygen in the breathing gas is 1.0 bar, the second indicia may be on and the third indicia may be on. When the partial pressure of oxygen in the breathing gas is above 1.0 bar, the third indicia may be on and the second indicia may flash in a cycle, with each flash in the cycle indicating that the partial pressure of oxygen in the breathing gas is 0.1 bar above 1.0 bar. When the partial pressure of oxygen in the breathing gas is below 1.0 bar, the second indicia may be on and the third indicia may flash in a cycle, with each flash in the cycle indicating that the partial pressure of oxygen in the breathing gas is 0.1 bar below 1.0 bar.

Alternatively, when the partial pressure of oxygen in the breathing gas is 1.0 bar, the second indicia and the third indicia may each simultaneously flash once. When the partial pressure of oxygen in the breathing gas is above 1.0 bar, the second indicia may flash in a cycle, with each flash in the cycle indicating that the partial pressure of oxygen in the breathing gas is 0.1 bar above 1.0 bar. When the partial pressure of oxygen in the breathing gas is below 1.0 bar, the third indicia may flash in a cycle, with each flash in the cycle indicating that the partial pressure of oxygen in the breathing gas is 0.1 bar below 1.0 bar.

There is also provided a heads-up display having a display panel which displays information related to a partial pressure of oxygen in a breathing gas. The display panel comprises a top indicia, a middle top indicia, a middle bottom indicia, and a bottom indicia. The top indicia and the bottom indicia respectively indicate a near hyperoxic condition and a near hypoxic condition. The middle top indicia and the middle bottom indicia together indicate the partial pressure of oxygen in the breathing gas.

The top indicia may flash to indicate the near hyperoxic condition. The bottom indicia may flash to indicate the near hypoxic condition. When the partial pressure of oxygen in the breathing gas is 1.0 bar, the middle top indicia may be on and the middle bottom indicia may be on. When the partial pressure of oxygen in the breathing gas is above 1.0 bar, the middle bottom indicia may be on and the middle top indicia may flash in a cycle, with each flash in the cycle indicating that the partial pressure of oxygen in the breathing gas is 0.1 bar above 1.0 bar. When the partial pressure of oxygen in the breathing gas is below 1.0 bar, the middle top indicia may be on and the middle bottom indicia may flash in a cycle, with each flash in the cycle indicating that the partial pressure of oxygen in the breathing gas is 0.1 bar below 1.0 bar.

Alternatively, when the partial pressure of oxygen in the breathing gas is 1.0 bar, the middle top indicia and the middle bottom indicia may each simultaneously flash once. When the partial pressure of oxygen in the breathing gas is above 1.0 bar, the middle top indicia may flash in a cycle, with each flash in the cycle indicating that the partial pressure of oxygen in the breathing gas is 0.1 bar above 1.0 bar. When the partial pressure of oxygen in the breathing gas is below 1.0 bar, the middle bottom indicia may flash in a cycle, with each flash in the cycle indicating that the partial pressure of oxygen in the breathing gas is 0.1 bar below 1.0 bar.

The heads-up display may further include a warning light to alert others to the near hyperoxic condition or the near hypoxic condition.

The improved heads-up display disclosed herein may be used to effectively display information related to the partial pressure of oxygen in the breathing gas to both color sighted users and color blind users.

BRIEF DESCRIPTIONS OF DRAWINGS

The invention will be more readily understood from the following description of the embodiments thereof given, by way of example only, with reference to the accompanying drawings, in which:

FIG. 8 is an elevation view of the display panel of the heads-up display of

Figure 1:
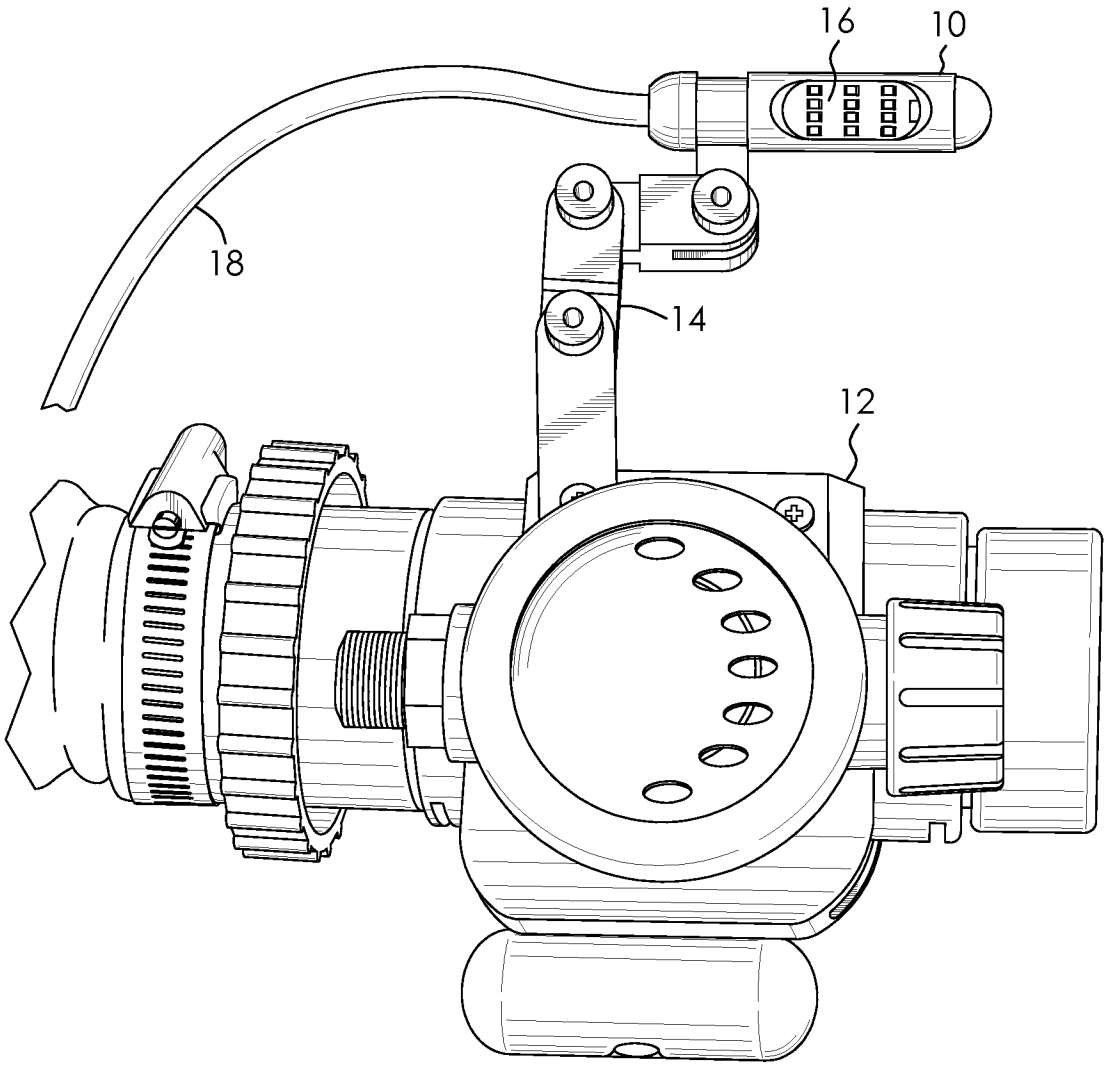
FIG. 1 is a perspective view of a heads-up display mounted on a rebreather.
Figure 9:
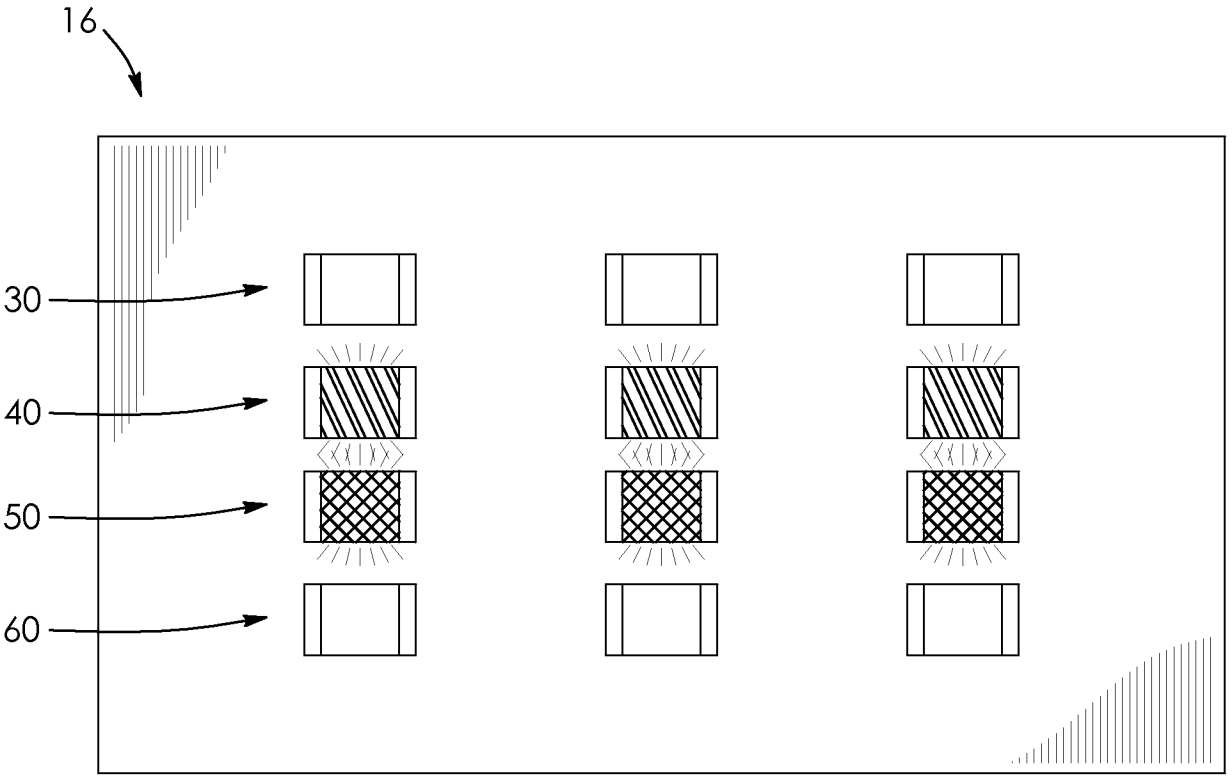
Figure 10:
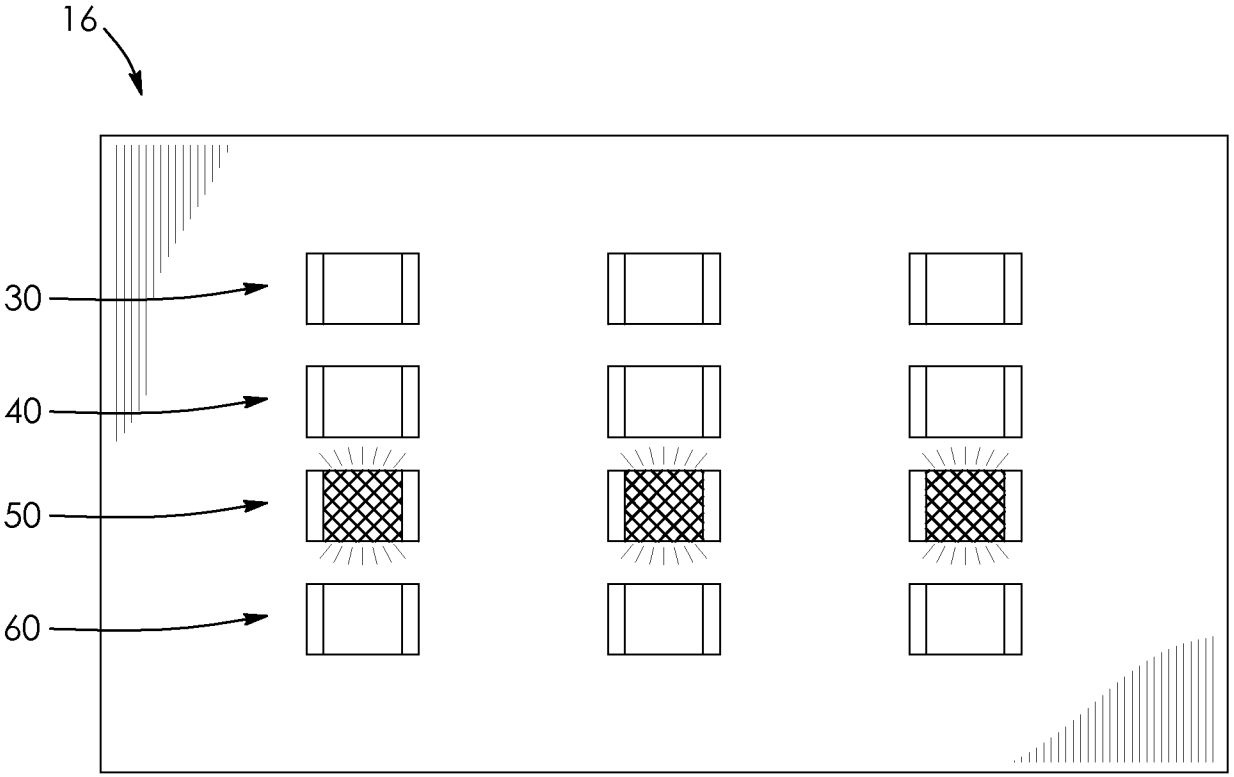
Figure 11:
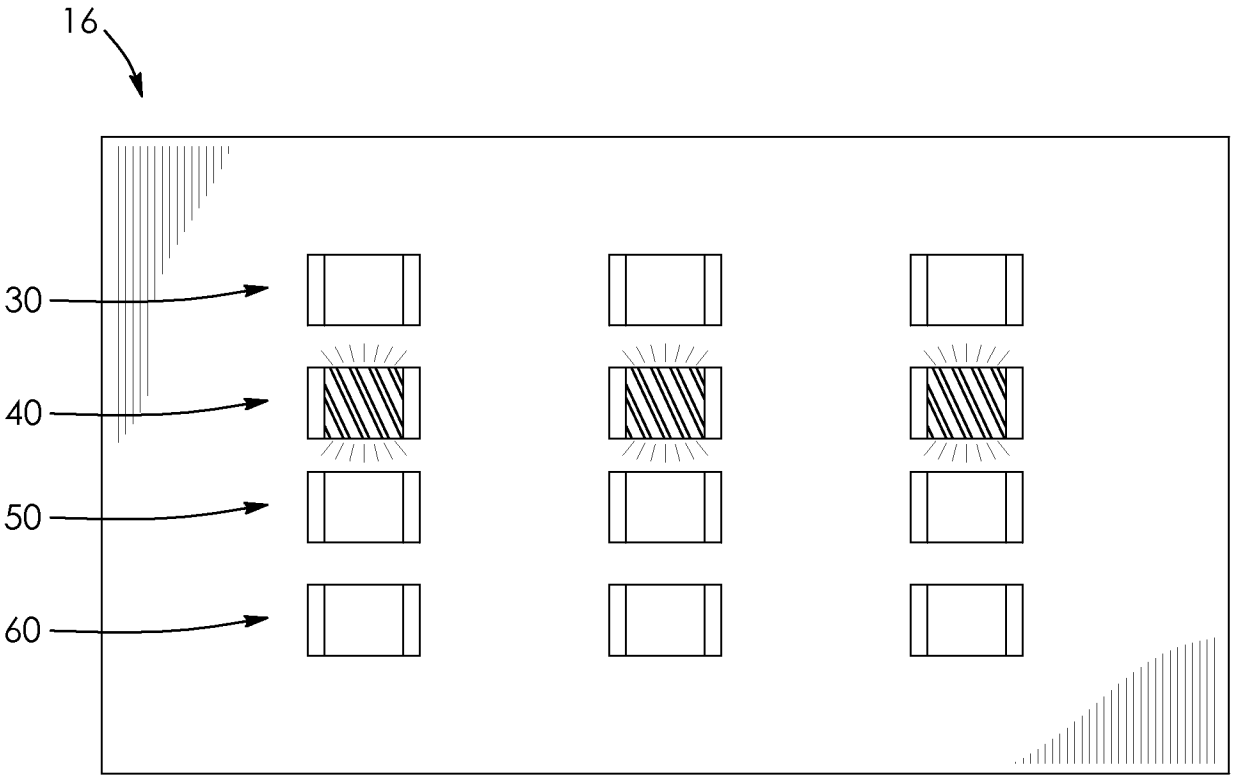

FIG. 1 displaying a partial pressure of oxygen of equal to or greater than 1.5 bar according to the first exemplar scheme;

FIG. 9 is an elevation view of the display panel of the heads-up display of FIG. 1 displaying a partial pressure of oxygen of 1.0 bar according to a second exemplar scheme;

FIG. 10 is an elevation view of the display panel of the heads-up display of FIG. 1 displaying a partial pressure of oxygen of greater than 1.0 bar according to the second exemplar scheme;

FIG. 11 is an elevation view of the display panel of the heads-up display of FIG. 1 displaying a partial pressure of oxygen of less than 1.0 bar according to the second exemplar scheme;

FIG. 12A is a table showing a logic of the first exemplar scheme; and

FIG. 12B is a table showing a logic of the second exemplar scheme.

DESCRIPTIONS OF THE PREFERRED EMBODIMENTS

Referring to the drawings and first to FIG. 1, there is shown an improved heads-up display 10 for a rebreather 12 which is shown in fragment. The rebreather is a conventional rebreather commonly used by divers and accordingly is not described in detail herein. The heads-up display is coupled to the rebreather 12 by an articulate arm 14. This allows a user to adjust the position of the heads-up display 10 in order to place the heads-up display 10 in the user's line of sight. The heads-up display 10 includes a display panel 16 which displays information related to the partial pressure of oxygen in the breathing gas. In FIG. 1, the heads-up display 10 is shown rotated axially approximately one hundred and eighty degrees from its position of use so that the display panel 16 is visible. This was done for illustrative purposes only and it will be understood by a person skilled in the art that when the heads-up display is in use that the display panel will be in the user's line of sight.

In this example, the heads-up display 10 is connected to a dive computer (not shown) by a cable 18, shown in fragment, which allows communication between the heads-up display 10 and the dive computer. However, in other examples, the heads-up display may be in wireless communication with the dive computer. Still alternatively, the heads-up display may be provided with a microprocessor which is in communication with oxygen sensors. The microprocessor may drive the display panel to display information related to the partial pressure of oxygen in the breathing gas based on signals received from the oxygen sensors.

Figure 2:
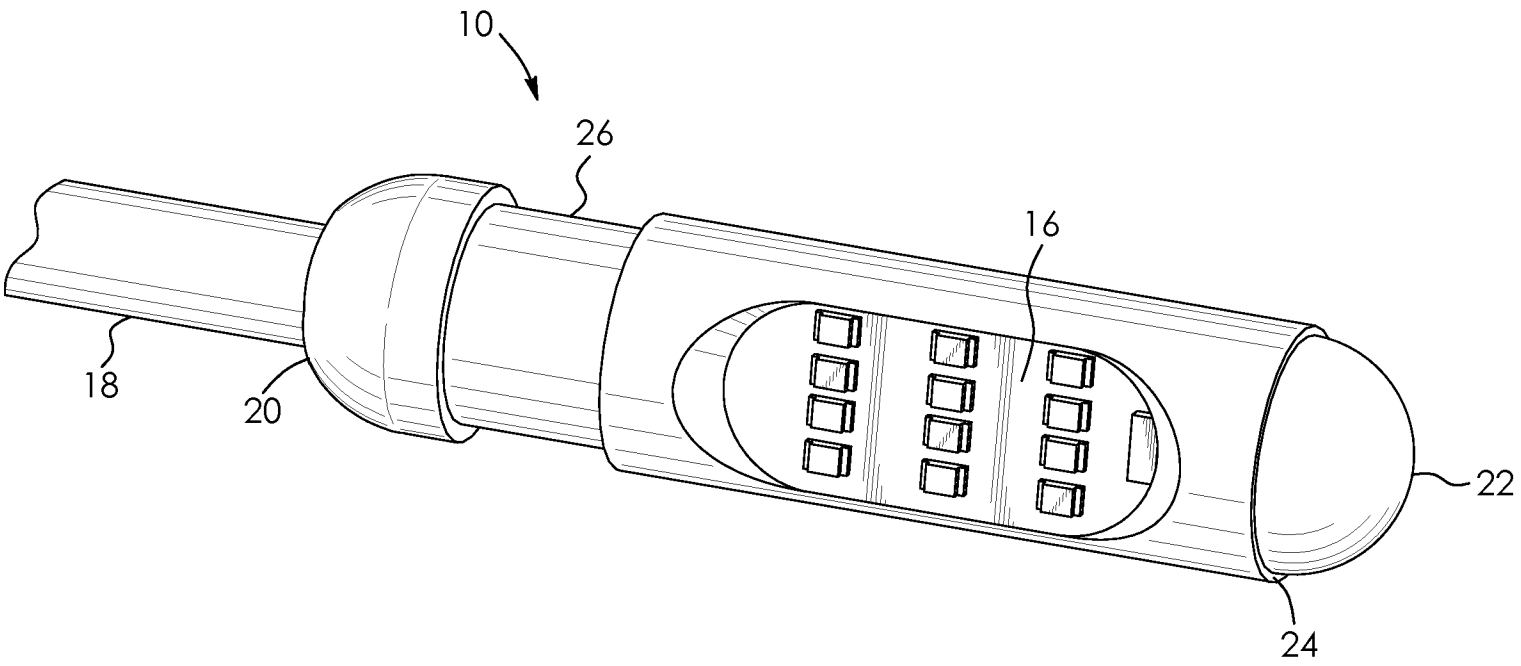
FIG. 2 is a perspective view of the heads-up display of FIG. 1.

The heads-up display 10 is best shown in FIG. 2 and is substantially cylindrical and elongate in this example but could be other shapes. The cable 18 is connected to a first end 20 of the heads-up display 10 and there is a warning light 22 at a second end 24 of the heads-up display 10. The warning light 22 will flash when the breathing gas is a near hypoxic mix or a near hyperoxic mix to advise others that the user may experiencing difficulties. There is also an annular recess 26 in the housing of the heads-up display 10. The annular recess 26 allows the heads-up display 10 to be mounted or retrofitted to an existing rebreather as shown, for example, in FIG. 1.

Figure 3:
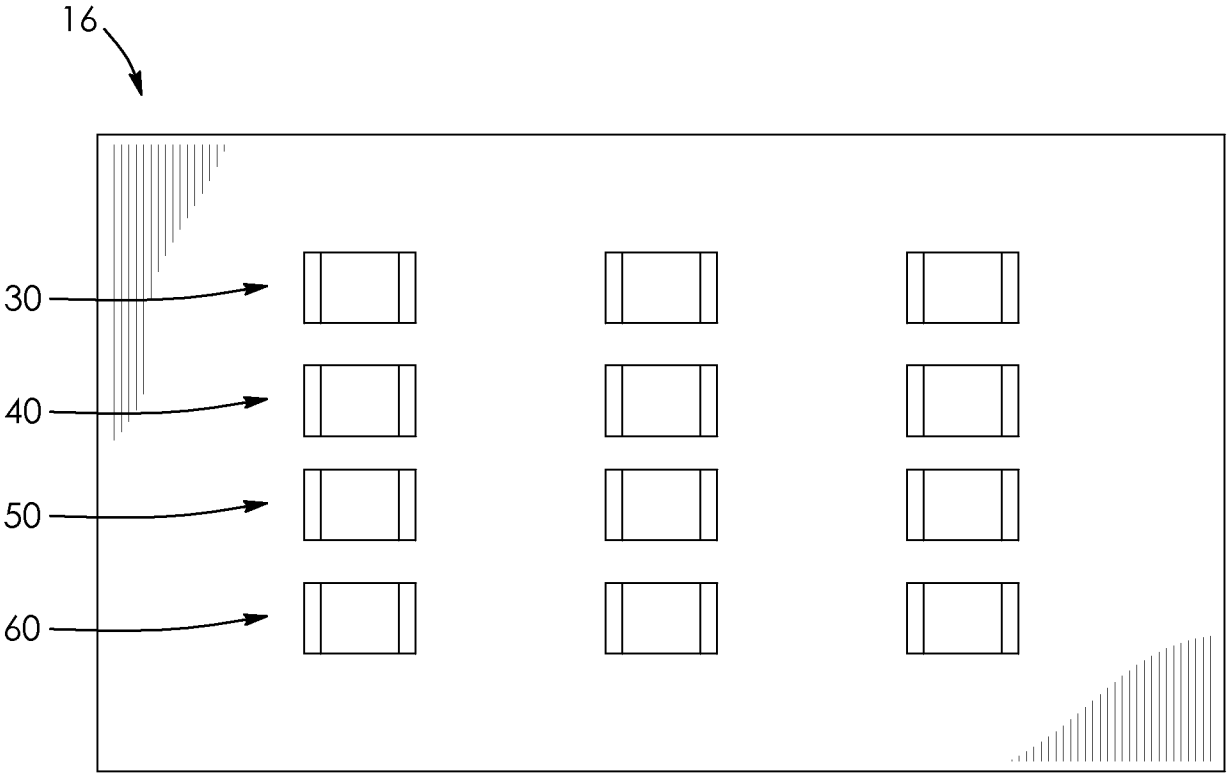
FIG. 3 is an elevation view of a display panel of the heads-up display of FIG. 1.

The display panel 16 of the heads-up display 10 is shown in greater detail in FIG. 3 and includes a plurality of indicia 30, 40, 50 and 60 which, in this example, are in the form of rows of light-emitting diodes. The spatial configuration of the indicia 30, 40, 50 and 60 relative to one another and the output of the light-emitting diodes are used to display information related to the partial pressure of oxygen in the breathing gas. In this example, indicia 30 is a top row of three red light-emitting diode packages, indicia 40 is a middle top row of three green light-emitting diode packages, indicia 50 is a middle bottom row of three amber light-emitting diode packages, and indicia 60 is a bottom row of three red light-emitting diode packages. A row of light-emitting diode packages is used as a redundancy in the event that one of the light-emitting diode packages fails.

Figure 4:
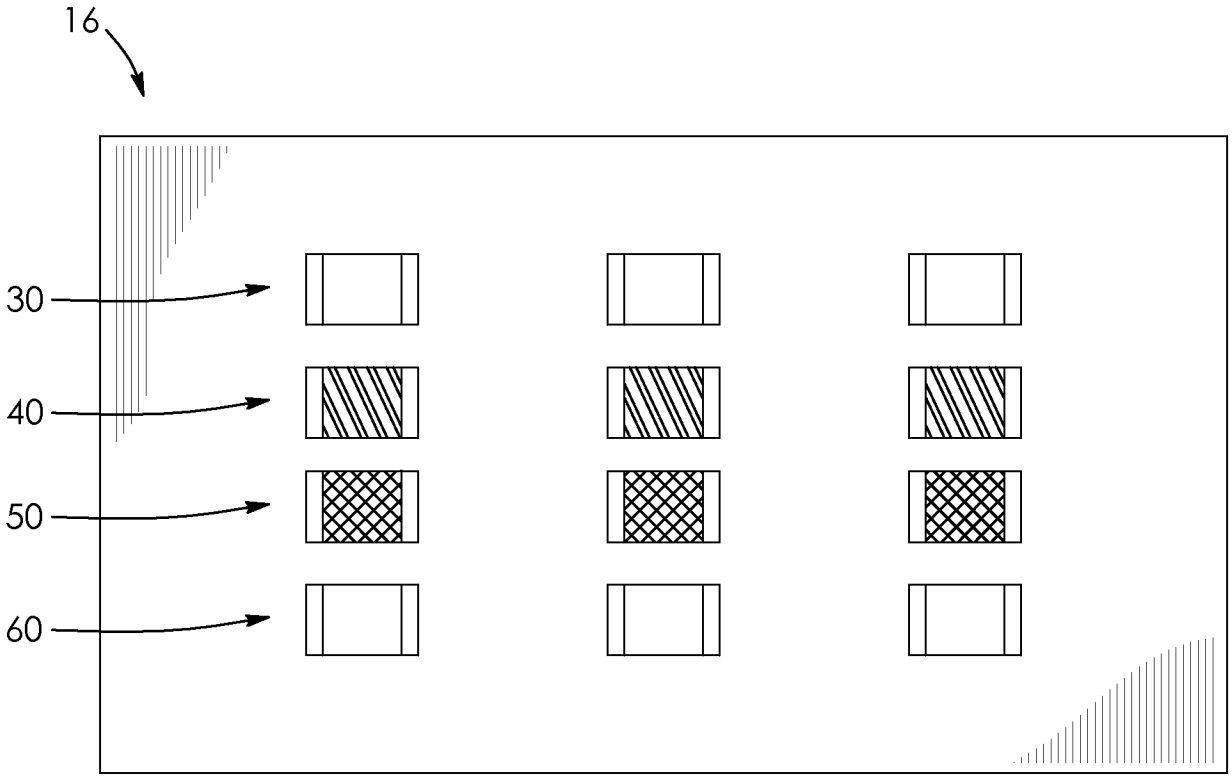
FIG. 4 is an elevation view of the display panel of the heads-up display of FIG. 1 displaying a partial pressure of oxygen of 1.0 bar according to a first exemplar scheme.
Figure 5:
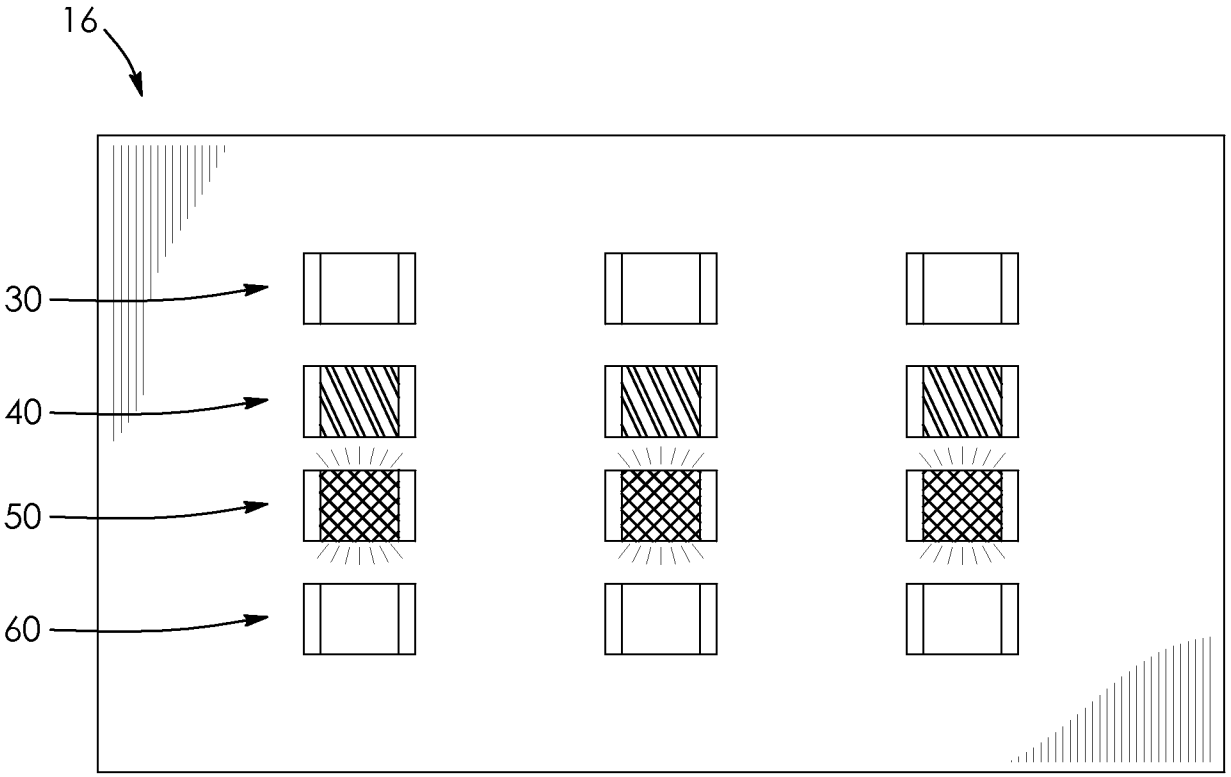
FIG. 5 is an elevation view of the display panel of the heads-up display of FIG. 1 displaying a partial pressure of oxygen of less than 1.0 bar according to the first exemplar scheme.
Figure 6:
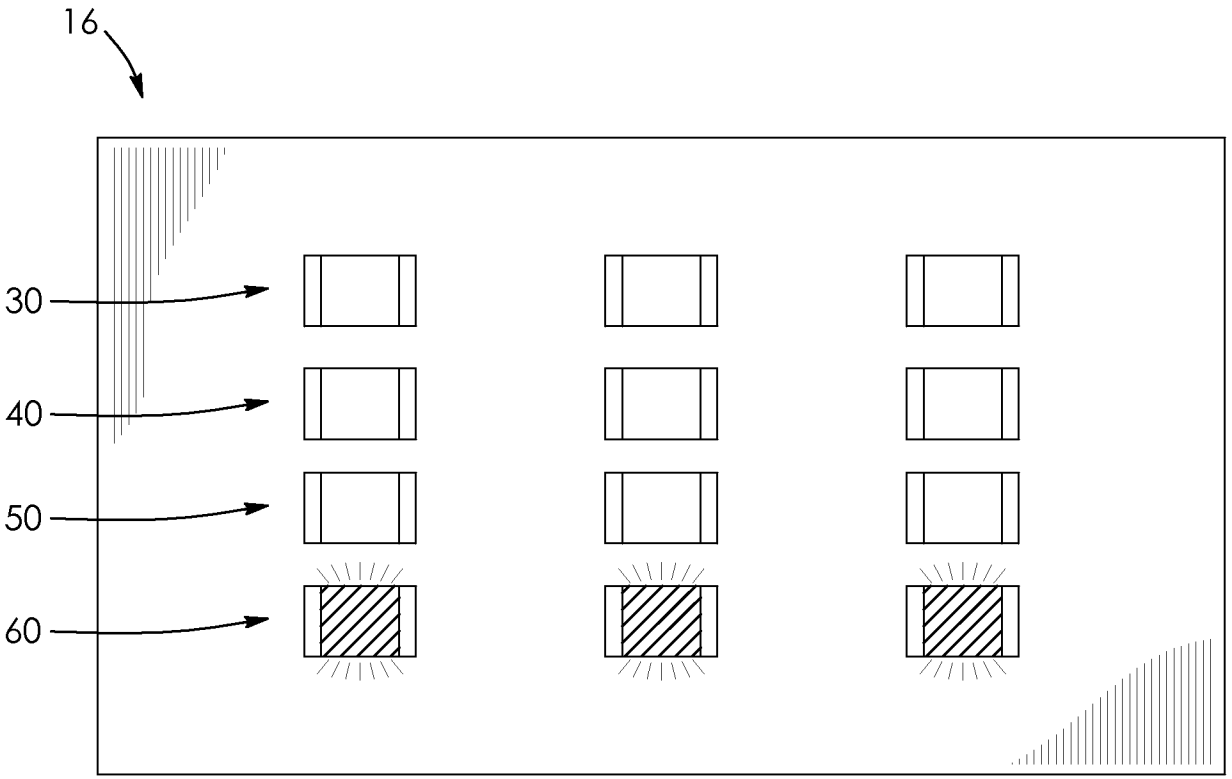
FIG. 6 is an elevation view of the display panel of the heads-up display of FIG. 1 displaying a partial pressure of oxygen of equal to or less than 0.4 bar according to the first exemplar scheme.

FIGS. 4 to 8 show a first exemplar scheme for displaying information related to the partial pressure of oxygen in the breathing gas. A partial pressure of oxygen of 1.0 bar is indicated, as shown in FIG. 4, by simultaneous solid lighting of the middle top row of green light-emitting diode packages and the middle bottom row of amber light-emitting diode packages. A partial pressure of oxygen of less than 1.0 bar is indicated, as shown in FIG. 5, by solid lighting of the middle top row of green light-emitting diode packages and flashing of the middle bottom row of amber light-emitting diode packages. Each flash of the middle bottom row of amber light-emitting diode packages in a cycle indicates a 0.1 bar below 1.0 bar. A partial pressure of oxygen of 0.6 bar is therefore indicated in this example by solid lighting of the middle top row of green light-emitting diode packages and a cycle of four flashes of the middle bottom row of amber light-emitting diode packages. An alarm condition of a near hypoxic mix of breathing gas is illustrated by flashing of the bottom row of red light-emitting diode packages as shown in FIG. 6. Each flash of the bottom row of red light-emitting diode packages in a cycle indicates a 0.1 bar below 1.0 bar. A partial pressure of oxygen of 0.3 bar is therefore indicated in this example by a cycle of seven flashes of the bottom row of red light-emitting diode packages. The warning light 22, shown in FIG. 2, also flashes in a similar manner during an alarm condition of a near hypoxic mix of breathing gas.

Figure 7:
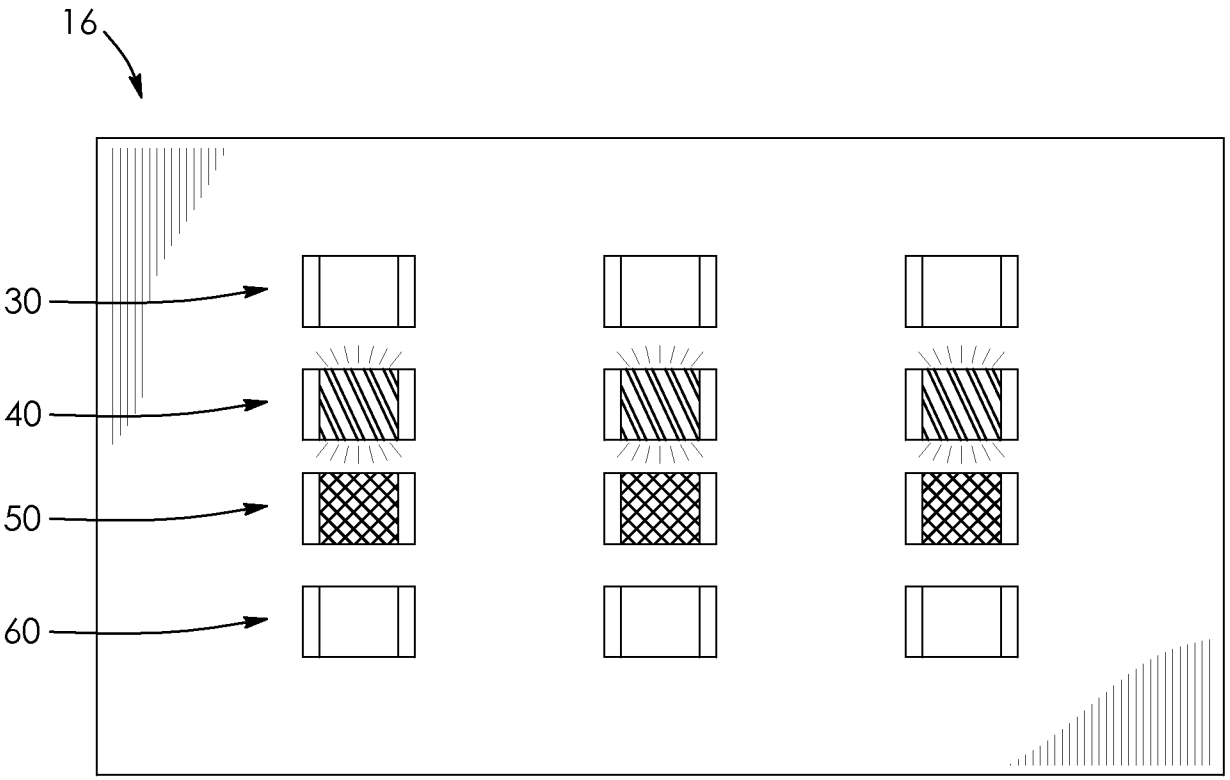
FIG. 7 is an elevation view of the display panel of the heads-up display of FIG. 1 displaying a partial pressure of oxygen of greater than 1.0 bar according to the first exemplar scheme.
Figure 8:
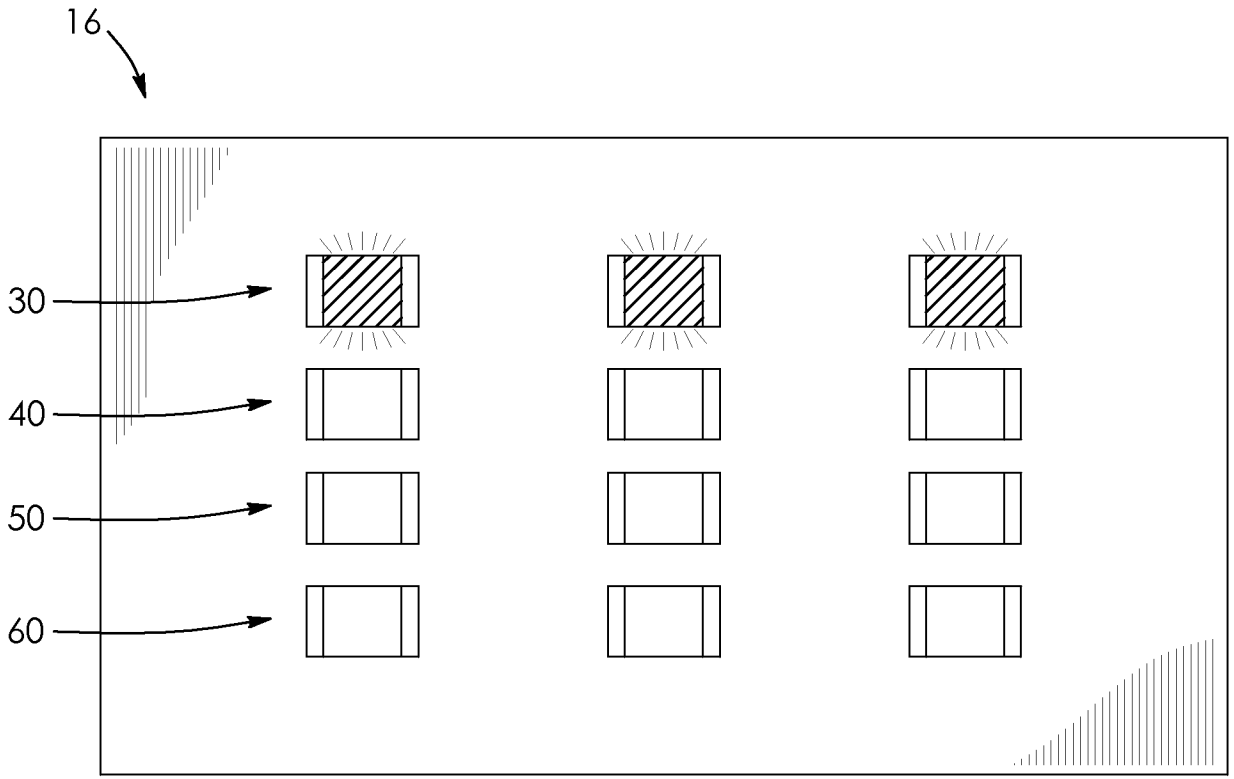

A partial pressure of oxygen of greater than 1.0 bar is indicated, as shown in FIG. 7, by solid lighting of the middle bottom row of amber light-emitting diode packages and flashing of the middle top row of green light-emitting diode packages. Each flash of the middle top row of green light-emitting diode packages in a cycle indicates a 0.1 bar over 1.0 bar. A partial pressure of oxygen of 1.4 bar is therefore indicated in this example by solid lighting of the middle bottom row of amber light-emitting diode packages and a cycle of four flashes of the middle top row of green light-emitting diode packages. An alarm condition of a near hyperoxic mix of breathing gas is illustrated by flashing of the top row of red light-emitting diode packages as shown in FIG. 8. Each flash of the top row of red light-emitting diode packages in a cycle indicates a 0.1 bar over 1.0 bar. A partial pressure of oxygen of 1.7 bar is therefore indicated in this example by a cycle of seven flashes of the top row of red light-emitting diode packages. The warning light 22, shown in FIG. 2, will also flash in a similar manner during an alarm condition of a near hyperoxic mix of breathing gas.

FIGS. 9 to 11 show a second exemplar scheme for displaying information related to the partial pressure of oxygen in the breathing gas. A partial pressure of oxygen of 1.0 bar is indicated, as shown in FIG. 9, by a simultaneous single flash of the middle top row of green light-emitting diode packages and the middle bottom row of amber light-emitting diode packages. A partial pressure of oxygen of less than 1.0 bar is indicated, as shown in FIG. 10, by flashing of the middle bottom row of amber light-emitting diode packages. Each flash of the middle bottom row of amber light-emitting diode packages in a cycle indicates a 0.1 bar below 1.0 bar. A partial pressure of oxygen of 0.6 bar is therefore indicated in this example by a cycle of four flashes of the middle bottom row of amber light-emitting diode packages. A partial pressure of oxygen of greater than 1.0 bar is indicated, as shown in FIG. 11, by flashing of the middle top row of green light-emitting diode packages. Each flash of the middle top row of green light-emitting diode packages in a cycle indicates a 0.1 bar over 1.0 bar. A partial pressure of oxygen of 1.4 bar is therefore indicated in this example by a cycle of four flashes of the middle top row of green light-emitting diode packages. Alarm conditions of the second exemplar scheme are the same as shown in FIGS. 6 and 8 and described above for the first exemplar scheme.

The logics of the first exemplar scheme and the second exemplar scheme are shown in FIGS. 12A and 12B, respectively. It can be seen from FIGS. 12A and 12B that the partial pressure of oxygen in the breathing gas can be independently determined by two parameters, namely, the color of the lit light-emitting diode packages and the relative spatial positions of the lit light-emitting diode packages. The heads-up display 10 may accordingly be used to effectively display information related to the partial pressure of oxygen in the breathing gas to both color sighted users and color blind users. Color blind users may determine the partial pressure of oxygen from spatial parameters alone, i.e. the position of the indicia alone without reference to the color of the indicia.

It will be understood by a person skilled in the art that many of the details provided above are by way of example only, and are not intended to limit the scope of the invention which is to be determined with reference to the following claims.

What is claimed is:

1. A heads-up display having a display panel which displays information related to a partial pressure of oxygen in a breathing gas, the display panel being in communication with a microprocessor which receives signals from oxygen sensors and the display panel comprising:

a first indicia;

a second indicia;

a third indicia; and a fourth indicia, wherein the microprocessor drives the display panel to display information related to the partial pressure of oxygen in breathing gas based on signals received from the oxygen sensors, the first indicia and the fourth indicia respectively indicate a near hyperoxic condition and a near hypoxic condition, and the second indicia and the third indicia together indicate the partial pressure of oxygen in the breathing gas; and wherein when the partial pressure of oxygen in the breathing gas is above 1.0 bar, the third indicia is on and the second indicia flashes in a cycle, with each flash in the cycle indicating that the partial pressure of oxygen in the breathing gas is 0.1 bar above 1.0 bar; and wherein when the partial pressure of oxygen in the breathing gas is below 1.0 bar, the second indicia is on and the third indicia flashes in a cycle, with each flash in the cycle indicating that the partial pressure of oxygen in the breathing gas is 0.1 bar below 1.0 bar.

2. The heads-up display as claimed in claim 1 wherein the first indicia flashes to indicate the near hyperoxic condition.

3. The heads-up display as claimed in claim 1 wherein the fourth indicia flashes to indicate the near hypoxic condition.

4. The heads-up display as claimed in claim 1 wherein when the partial pressure of oxygen in the breathing gas is 1.0 bar, the second indicia is on and the third indicia is on.

5. The heads-up display as claimed in claim 1 wherein when the partial pressure of oxygen in the breathing gas is 1.0 bar, the second indicia and the third indicia each simultaneously flash once.

6. The heads-up display as claimed in claim 1 wherein the heads-up display further includes a warning light to alert others to the near hyperoxic condition or the near hypoxic condition.

7. A heads-up display having a display panel which displays information related to a partial pressure of oxygen in a breathing gas, the display panel being in communication with a microprocessor which receives signals from oxygen sensors and the display panel comprising:

a top indicia;

a middle top indicia;

a middle bottom indicia; and a bottom indicia, wherein the microprocessor drives the display panel to display information related to the partial pressure of oxygen in breathing gas based on signals received from the oxygen sensors, the top indicia and the bottom indicia respectively and individually indicate a near hyperoxic condition and a near hypoxic condition, and the middle top indicia and the middle bottom indicia together indicate the partial pressure of oxygen in the breathing gas; and wherein when the partial pressure of oxygen in the breathing gas is above 1.0 bar, the middle bottom indicia is on and the middle top indicia flashes in a cycle, with each flash in the cycle indicating that the partial pressure of oxygen in the breathing gas is 0.1 bar above 1.0 bar; and wherein when the partial pressure of oxygen in the breathing gas is below 1.0 the middle top indicia is on and the middle bottom indicia flashes in a cycle, with each flash in the cycle indicating that the partial pressure of oxygen in the breathing gas is 0.1 bar below 1.0 bar.

8. The heads-up display as claimed in claim 7 wherein the top indicia flashes to indicate the near hyperoxic condition.

9. The heads-up display as claimed in claim 7 wherein the bottom indicia flashes to indicate the near hypoxic condition.

10. The heads-up display as claimed in claim 7 wherein when the partial pressure of oxygen in the breathing gas is 1.0 bar, the middle top indicia is on and the middle bottom indicia is on.

11. The heads-up display as claimed in claim 7 wherein when the partial pressure of oxygen in the breathing gas is 1.0 bar, the middle top indicia and the middle bottom indicia each simultaneously flash once.

12. The heads-up display as claimed in claim 7 wherein the heads-up display further includes a warning light to alert others to the near hyperoxic condition or the near hypoxic condition.

* * * * *